US010832900B2

(12) United States Patent
Green et al.

(10) Patent No.: US 10,832,900 B2
(45) Date of Patent: Nov. 10, 2020

(54) MASS FILTER HAVING EXTENDED OPERATIONAL LIFETIME

(71) Applicant: Micromass UK Limited, Wilmslow (GB)

(72) Inventors: Martin Green, Bowdon (GB); Jason Wildgoose, Stockport (GB); Keith Richardson, High Peak (GB); Kevin Giles, Stockport (GB); Daniel Kenny, Knutsford (GB); David Langridge, Macclesfield (GB); Richard Moulds, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/563,203

(22) Filed: Sep. 6, 2019

(65) Prior Publication Data

US 2020/0075308 A1 Mar. 5, 2020

Related U.S. Application Data

(63) Continuation of application No. 15/578,053, filed as application No. PCT/GB2016/051581 on May 31, 2016, now Pat. No. 10,453,667.

(30) Foreign Application Priority Data

May 29, 2015 (GB) ..... 1509243.0

(51) Int. Cl.
*H01J 49/42* (2006.01)
*H01J 49/06* (2006.01)

(52) U.S. Cl.
CPC ..... *H01J 49/4215* (2013.01); *H01J 49/063* (2013.01); *H01J 49/067* (2013.01); *H01J 49/4255* (2013.01)

(58) Field of Classification Search
CPC ..... H01J 49/06; H01J 49/063; H01J 49/067; H01J 49/42; H01J 49/4215; H01J 49/4255
See application file for complete search history.

(56) References Cited

U.S. PATENT DOCUMENTS 5,525,084 A * 6/1996 Broadbent ..... H01J 49/068 250/292
2005/0006580 A1* 1/2005 Hager ..... H01J 49/0045 250/292

(Continued)

FOREIGN PATENT DOCUMENTS

JP 2011509513 A 3/2011

OTHER PUBLICATIONS

Swingler, D.L., "The Use of Slotted Poles in a Quadrupole Mass Filter", International Journal of Mass Spectrometry and Ion Processes, 54 (1983) 225-230 (Year: 1983).*

(Continued)

*Primary Examiner* — David E Smith

(57) ABSTRACT

A mass filter is disclosed having at least one electrode (42-48) comprising an aperture (43) or recess. Voltages are applied to the electrodes (42-48) of the mass filter such that ions having mass to charge ratios in a desired range are confined by the electrodes and are transmitted along and through the mass filter, whereas ions (47,49) having mass to charge ratios outside of said desired range are unstable and pass into the aperture (43) or recess such that they are filtered out by the mass filter. The aperture (43) or recess reduces or eliminates the number of ions that would otherwise impact the electrode surface facing the ion transmission axis and hence reduces degradation of the ion transmission properties of the mass filter.

17 Claims, 8 Drawing Sheets

(56) References Cited

U.S. PATENT DOCUMENTS

| | | | | |
|---|---|---|---|---|
| 2005/0127283 | A1* | 6/2005 | Marriott | H01J 49/4215 250/281 |
| 2009/0095898 | A1* | 4/2009 | Collings | H01J 49/0045 250/282 |
| 2015/0364309 | A1* | 12/2015 | Welkie | H01J 49/40 250/282 |

OTHER PUBLICATIONS

International Preliminary Report on Patentability for International application No. PCT/GB2016/051581, dated Dec. 5, 2017, 13 pages.

Communication pursuant to Article 94(3) EPC, for Application No. EP16727783.9, dated Feb. 12, 2020, 9 pages.

Watson, J.T., & Sparkman, O.D., "Introduction to Mass Spectrometry—Instrumentation, Applications, and Strategies for Data Interpretation", Fourth Edition, John Wiley & Sons, Ltd., (Chichester, Wiley), pp. 53-172 (2007).

* cited by examiner

MASS FILTER HAVING EXTENDED OPERATIONAL LIFETIME

CROSS-REFERENCE TO RELATED APPLICATION

This application is a continuation of U.S. patent application Ser. No. 15/578,053, filed Nov. 29, 2017, now U.S. Pat. No. 10,453,667, which claims priority from and the benefit of United Kingdom patent application No. 1509243.0 filed on May 29, 2015, the entire contents of which are incorporated herein by reference.

FIELD OF THE INVENTION

The present invention relates generally to mass and/or ion mobility spectrometers and in particular to mass filters that selectively transmit ions within a specific range of mass to charge ratios.

BACKGROUND

It is known to use quadrupole mass filters so as to selectively transmit ions within a specific range of mass to charge ratios. A quadrupole mass filter transmits ions that satisfy conditions of stability within the quadrupole field, wherein the stability conditions are defined by the dimensionless parameters q and a:

$$q = \frac{4eV}{r_0^2\omega^2 m} \tag{1}$$

$$a = \frac{2eU}{r_0^2\omega^2 m} \tag{2}$$

where e is the charge of the ion, V is the amplitude of the RF voltage applied to the quadrupole electrodes, $r_0$ is the inscribed radius between the rods of the quadrupole, ω is the angular frequency of the RF voltage applied to the quadrupole (in radians/sec), m is the mass of the ion, and U is the resolving DC voltage.

Ions having values of a and q that result in unstable ion trajectories generally impact on the rods of the quadrupole and are lost. This property is exploited when the quadrupole rod set is used as a mass filter, such that the majority of the ions that are not desired to be transmitted by the mass filter impact on the inner surfaces of the rod electrodes. However, over time the inner surfaces of the rods become contaminated by the ions and the electronic charge builds up on their surfaces. Eventually, local charging of the contaminated surfaces results in degradation of performance of the mass filter. This may result in loss of transmission, loss of resolution or poor peak shape. If this occurs the mass filter must be removed from the vacuum chamber and cleaned.

It is therefore desired to provide an improved mass and/or ion mobility spectrometer, an improved method of mass and/or ion mobility spectrometry, and an improved mass filter.

SUMMARY

From a first aspect of the present invention there is provided a method of mass filtering ions comprising:

mass filtering ions using a first mass filter so as to mass selectively transmit only ions having a first range of mass to charge ratios; and mass filtering the ions transmitted by the first mass filter using a second mass filter, wherein the second mass filter only transmits ions having a second range of mass to charge ratios that is a sub-set of the first range of mass to charge ratios;

wherein at least one electrode of the first mass filter comprises an aperture extending entirely through the electrode and/or comprises a recess extending only partially through the electrode, wherein the aperture and/or recess is arranged and configured such that ions that are unstable in the first mass filter pass into or through the aperture and/or into the recess such that they are not transmitted by the first mass filter.

The present invention provides a lower resolution first mass filter upstream of a higher resolution second mass filter. The first mass filter may filter out the majority of unwanted background ions and hence prevent these ions from impacting on the electrodes of the second mass filter and causing surface charging. This maintains the performance of the second mass filter over an extended period of time. The effect of surface charging on the first mass filter is less severe than that for second mass filters and hence the use of the first mass filter improves the transmission characteristics of the overall instrument as compared to the use of the higher resolution mass filter alone. Furthermore, the aperture and/or recess in the at least one electrode of the first mass filter is configured such that some or all of the ions which have unstable trajectories in the first mass filter pass through the electrode or impinge on a surface of the electrode that is remote from the surface of the electrode closest to the central axis of the first mass filter. As such, surface charging on the first mass filter is maintained relatively low, thereby maintaining good transmission characteristics of the first mass filter.

GB 2388705 discloses the use of a low resolution sacrificial filter upstream of a high resolution analytical filter to avoid contamination of the analytical filter. However, the sacrificial filter does not comprise an electrode having an aperture extending entirely therethrough or a recess extending only partially therethrough, wherein the aperture or recess is arranged and configured such that ions that are unstable in the sacrificial filter pass through or into the aperture or recess. The ions strike the surfaces of the electrodes in the sacrificial filter close to the ion transmission axis and these surfaces become contaminated relatively quickly, causing surface charging of the electrodes. As such, the performance of the sacrificial filter is reduced relatively quickly.

For the avoidance of doubt, the second range of mass to charge ratios according to the first aspect of the present invention is narrower than the first range of mass to charge ratios, and is within the first range of mass to charge ratios. The second range of mass to charge ratios may be capable of transmitting ions of only a single mass to charge ratio.

The first range of mass to charge ratios may be the range of mass to charge ratios able to be simultaneously transmitted by the first mass filter at any given time, and the second range of mass to charge ratios may be the range of mass to charge ratios able to be simultaneously transmitted by the second mass filter at substantially said given time.

The first mass filter and/or second mass filter may be a multipole mass filter, such as a quadrupole mass filter.

The method may comprise applying RF and DC voltages to electrodes of the first mass filter and/or to electrodes of the second mass filter so as to confine ions desired to be transmitted between the electrodes and to cause ions that are not desired to be transmitted to be unstable and not confined between the electrodes. The RF and DC voltages may be applied such that at least some of the ions that are unstable in the first mass filter pass into or through said aperture and/or recess in the electrode.

The method may comprise applying RF voltages having the same amplitude and/or frequency to the electrodes of the first and second mass filters, and applying a lower amplitude DC resolving voltage to the first mass filter than the second mass filter.

At least some of the ions filtered out by the first and/or second mass filters may impact on electrodes of the first and/or second mass filters respectively. Fewer ions may impact on the electrodes of the second mass filter than the first mass filter.

The first range of mass to charge ratios may be centred on substantially the same mass to charge ratio as the second range of mass to charge ratios.

The second mass range may have a width that is x % of the first mass range, wherein x is selected from the group consisting of: ≤95; ≤90; ≤85; ≤80; ≤75; ≤70; ≤65; ≤60; ≤55; ≤50; ≤45; ≤40; ≤35; ≤30; ≤25; ≤20; ≤15; ≤10; and ≤5.

The method may comprise: (i) guiding the ions transmitted by the first mass filter into the second mass filter using a first ion guide arranged between, optionally directly between, the first mass filter and the second mass filter; and/or (ii) guiding the ions into the first mass filter using a second ion guide arranged upstream, optionally directly upstream, of the first mass filter. Optionally, the first ion guide and/or second ion guide is an RF-only ion guide to which only RF potentials are applied and not DC potentials.

The amplitude of the RF voltage applied to the first ion guide may be smaller or the same as the amplitude of the RF voltage applied to the electrodes of the first and/or second mass filter.

The amplitude of the RF voltage applied to the second ion guide may be smaller or the same as the amplitude of the RF voltage applied to the electrodes of the first and/or second mass filter.

The amplitude of the RF voltage applied to the first ion guide may be the same as the amplitude of the RF voltage applied to the second ion guide.

The first ion guide may be arranged and provided so as to control the fringing electric fields at the entrance to the second mass filter so as to allow ions to enter the second mass filter without becoming unstable.

The second ion guide may be arranged and provided so as to control the fringing electric fields at the entrance to the first mass filter so as to allow ions to enter the first mass filter without becoming unstable.

The first and/or second ion guide may be a multipole ion guide such as a quadrupole ion guide. However, other ion guides may be used, such as an ion tunnel ion guide formed from a plurality of apertured electrodes spaced apart along the axis of the ion guide and operated such that ions are guided through the apertures.

The method may comprise operating the first ion guide as a mass filter so as to only transmit ions having mass to charge ratios at or above a first threshold value, wherein the first threshold value is at or below the lower limit of said second range of mass to charge ratios; and/or operating the first ion guide as a mass filter so as to only transmit ions having mass to charge ratios at or below a second threshold value, wherein the second threshold value is at or above said second range of mass to charge ratios.

The first threshold value may be between the lower limits of the first and second ranges of mass to charge ratios.

The second threshold value may be between the upper limits of the first and second ranges of mass to charge ratios.

The method may comprise operating the second ion guide as a mass filter so as to only transmit ions having mass to charge ratios at or above a third threshold value, wherein the third threshold value is at or below the lower limit of said first range of mass to charge ratios; and/or operating the first ion guide as a mass filter so as to only transmit ions having mass to charge ratios at or below a fourth threshold value, wherein the fourth threshold value is at or above said first range of mass to charge ratios At least one of the electrodes of the second mass filter and/or at least one of the electrodes of the first ion guide and/or at least one of the electrodes of the second ion guide; may comprise an aperture extending entirely through the electrode and/or comprises a recess extending only partially through the electrode, wherein the aperture and/or recess may be arranged and configured such that ions that are unstable in the second mass filter or ion guide pass into or through the aperture and/or into the recess such that they are not transmitted by the second mass filter or ion guide. It is advantageous for the second mass filter to include such an aperture or recess in at least one of its electrodes, since this reduces the contamination of the apertured or recessed electrodes from the ions that are filtered out by the second mass filter. However, some benefit may also be obtained by providing an aperture or recess in at least one of the electrodes of the first and/or second ion guide, e.g. to reduce contamination from ions that are unstable in the ion guide.

The aperture and/or recess is configured such that some or all of the ions which have unstable trajectories in the mass filter or ion guide either pass through the electrode or impinge on a surface of the electrode that is remote from the surface of the electrode closest to the central axis of the mass filter or ion guide. This eliminates or reduces surface charging of the electrode near to the ion transmission axis through the mass filter or ion guide, thus maintaining good ion transmission properties.

The electrode having the aperture or recess may be elongated in a direction along the length of the mass filter or ion guide, and the aperture may be a slotted aperture or the recess is a slotted recess.

The aperture and/or recess may extend over only part of the length of the electrode. It is also contemplated that a plurality of such apertures and/or recesses may be arranged along the length of the electrode. Alternatively, the aperture and/or recess may extend over the entire length of the electrode. For example, it is contemplated that the aperture may divide the electrode into two separate portions.

The aperture or recess may increase in cross-sectional area in a direction away from the central axis of the mass filter or ion guide, e.g. so that the cross-sectional area increases in a tapered manner in a radially outward direction.

As described above, any one of the first mass filter, second mass filter, first ion guide or second ion guide may be a multipole rod set of electrodes such as a quadrupole rod set. Any number of electrodes in the rod set, including all rod electrodes, may comprise the aperture and/or recess described herein.

The method may comprise arranging a conductive grid or mesh over or in the aperture or recess so as to support an electric field generated by the electrode.

Ions that pass into or through the aperture or recess may not be detected and may be neutralised or discarded.

At least one of the electrodes of the first mass filter and/or at least one of the electrodes of the second mass filter and/or at least one of the electrodes of the first ion guide and/or at least one of the electrodes of the second ion guide; may be axially segmented so as to comprise segments that are spaced apart along the longitudinal axis by one or more gaps, optionally wherein the gaps are arranged and configured such that ions that are unstable in the mass filter or ion guide pass into or through the gaps such that they are not transmitted by the mass filter or ion guide.

All of the electrodes of the first mass filter and/or second mass filter and/or first ion guide and/or second ion guide may be segmented.

At least some of the electrode segments may comprise said apertures or recesses.

At least some of the electrodes of the first mass filter and/or second ion guide may be heated. Heating the first mass filter and/or second ion guide prevents or inhibits contaminants from condensing onto the electrodes of the first mass filter and/or second ion guide, and hence reduces surface charging of these components. Heating the electrodes may cause thermal expansion of the electrodes. However, as the first mass filter has a lower resolution than that of the second mass filter, and as the second ion guide is not required to resolve ions, the effects of heating the electrodes are less problematic than if the electrodes of the second mass filter were heated. For example, if the second mass filter was heated then the instrument may be required to be left to stabilise for several hours before use.

The second mass filter may be unheated. This avoids thermal expansion of the electrodes in the second mass filter and the related adverse effects on its resolution.

The first ion guide may be unheated. This provides a thermal break between heated first mass filter and the unheated second mass filter, thus minimising heat transfer to the second mass filter, which would otherwise adversely affect its performance. However, it is contemplated that the first ion guide may be heated.

An RF-only post filter may be provided downstream of the second mass filter, which may be unheated.

Optionally, at least some of the electrodes of the second ion guide may be heated.

Although less desirable, it is contemplated that at least some of the electrodes of the second mass filter may be heated.

In embodiments in which electrodes are heated, the electrodes may be heated to a temperature selected from the group consisting of: 40° C.; 50° C.; 60° C.; 80° C.; 100° C.; 120° C.; 140° C.; 160° C.; 180° C.; 200° C.; and between 100° C. and 300° C. The pressure within the first mass filter and/or second mass filter (optionally and/or first ion guide and/or second ion guide) may be substantially the same. The pressure in the first mass filter and/or second mass filter (and/or first ion guide and/or second ion guide) may be in the range of $10^{-7}$ mbar to $10^{-4}$ mbar. All of these devices may be maintained at the same pressure.

The pressure within the first mass filter and/or second mass filter (optionally and/or first ion guide and/or second ion guide) may be either $9\times10^{-3}$ mbar or between $10^{-7}$ and $9\times10^{-3}$ mbar. Alternatively, the pressure within the first mass filter and/or second mass filter (optionally and/or first ion guide and/or second ion guide) may be selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

The first mass filter and/or second mass filter (optionally and/or first ion guide and/or second ion guide) may be arranged in a single vacuum chamber.

The method may comprise applying an AC or RF voltage to the electrodes of the first mass filter and/or second mass filter (optionally and/or first ion guide and/or second ion guide); wherein the frequency of the AC or RF voltage is <1 MHz or >1 MHz. Alternatively, the frequency may be selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The first mass filter may be shorter in length than the second mass filter.

The method may comprise detecting ions transmitted by the second mass filter, and/or or mass analysing ions transmitted by the second mass filter, and/or ion mobility analysing ions transmitted by the second mass filter.

A mass filter having at least one apertured or recessed electrode as described above is believed to be novel and inventive in its own right.

Accordingly, a second aspect of the present invention provides a method of mass filtering ions comprising:

supplying ions to a mass filter formed from a plurality of electrodes, wherein at least one of the electrodes comprises an aperture extending entirely through the electrode and/or comprises a recess extending only partially through the electrode; and applying voltages to the electrodes such that ions having mass to charge ratios in a desired range are confined by the electrodes and are transmitted along and through the mass filter, whereas ions having mass to charge ratios outside of said desired range are unstable and pass into or through the aperture and/or into the recess such that they are filtered out by the mass filter;

wherein ions that pass into or through the aperture and/or into the recess are not detected and are neutralised or discarded.

Multipole ion traps having slotted apertures in the electrodes are known. RF voltages are applied to the electrodes so as to mass selectively eject ions out of the ion trap through the slotted apertures. The ions are then detected on an ion detector. However, it has not been recognised that apertures or recesses can be provided in the electrodes of a mass filter so as to avoid the undesired ions impacting on the inner surfaces of the electrodes and causing surface charging, which would otherwise affect the transmission properties of the mass filter.

The mass filter may have any of the features of the first and/or second filter described above in relation to the first aspect of the invention.

For example, the electrodes of the mass filter may define a central axis along which ions having mass to charge ratios in the desired range are transmitted, wherein the unstable ions pass into an entrance of said aperture or recess, and wherein said entrance is located in a surface of the electrode facing the central axis.

The aperture and/or recess is configured such that some or all of the ions which have unstable trajectories in the mass filter either pass through the electrode or impinge on a surface of the electrode that is remote from the surface of the electrode closest to the central axis of the mass filter. Therefore the inner surface of the electrode does not become contaminated by the undesired ions and so does not affect the transmission properties of the mass filter.

The electrode having the aperture or recess may be elongated in a direction along the length of the mass filter, and the aperture may be a slotted aperture or the recess may be a slotted recess.

The aperture and/or recess may extend over only part of the length of the electrode. It is also contemplated that a plurality of such apertures and/or recesses may be arranged along the length of the electrode. Alternatively, the aperture and/or recess may extend over the entire length of the electrode. For example, it is contemplated that the aperture may divide the electrode into two separate portions.

The aperture or recess may increase in cross-sectional area in a direction away from the central axis of the mass filter, e.g. so that the cross-sectional area increases in a tapered manner in a radially outward direction.

The aperture or recess may be elongated and extend longitudinally in a direction along the longitudinal axis of the mass filter. Alternatively, the aperture or recess may extend partially, or wholly, around the circumference of the mass filter.

A conductive grid or mesh may be arranged over or in the aperture or recess so as to support an electric field generated by the electrode.

The mass filter may be a multipole mass filter and the plurality of electrodes may be rod set electrodes. For example, the mass filter may be a quadrupole mass filter.

Any number of electrodes in the rod set, including all rod electrodes, may comprise the aperture and/or recess described herein. For example, each of at least two, at least three, or at least four of said plurality of electrodes comprise one of said apertures and/or recesses.

The method may comprise applying only RF voltages and no DC voltages to said electrodes so as to mass filter the ions. Alternatively, the method may comprise applying RF voltages and DC voltages to said electrodes so as to mass filter the ions.

A least some of the electrodes of the mass filter may be heated. The electrode(s) may be heated to a temperature selected from the group consisting of: ≥40° C.; ≥50° C.; ≥60° C.; ≥80° C.; ≥100° C.; ≥120° C.; ≥140° C.; ≥160° C.; ≥180° C.; ≥200° C.; between 40° C. and 220° C.; and between 50° C. and 200° C.

The use of an apertured or recessed electrode has been described above for reducing contamination and surface charging. However, it is alternatively contemplated herein that the electrode may be axially segmenting so as to reduce contamination and surface charging.

Accordingly, from a third aspect the present invention provides a method of mass filtering ions comprising:

supplying ions to a mass filter formed from an axially segmented multipole rod set of electrodes having axial segments that are separated by gaps; and applying voltages to the electrodes such that ions having mass to charge ratios in a desired range are confined by the electrodes and are transmitted along and through the mass filter, whereas ions having mass to charge ratios outside of said desired range are unstable and pass into or through the gaps such that they are filtered out by the mass filter.

The method and mass filter may have any features described above in relation to the first or second aspects of the invention, except that the electrodes of the mass filter are axially segmented at need not necessarily comprise the aperture or recess. However, it is contemplated that any individual axial segment may comprise one of the apertures or recesses.

For example, the mass filter may be a quadrupole mass filter.

RF and DC voltages may be applied to the electrodes of the mass filter so as to confine ions desired to be transmitted between the electrodes and to cause ions that are not desired to be transmitted to be unstable and not confined between the electrodes, e.g. the unstable ions may be radially excited.

The RF and DC voltages may be applied such that at least some of the ions that are unstable in the mass filter pass into or through said gaps in the electrode.

The method may comprise arranging a conductive grid or mesh over the gaps, e.g. so as to support an electric field generated by the electrodes.

Ions that pass into or through the gaps are not detected and are neutralised or discarded.

At least some of the electrodes of the mass filter may be heated, e.g. to a temperature selected from the group consisting of: ≥40° C.; ≥50° C.; ≥60° C.; ≥80° C.; ≥100° C.; ≥120° C.; ≥140° C.; ≥160° C.; ≥180° C.; ≥200° C.; and between 100° C. and 300° C.

The method may comprise applying an AC or RF voltage to the electrodes of the mass filter, wherein the frequency of the AC or RF voltage is <1 MHz or >1 MHz.

At least some of the axial segments of at least one rod of the rod set may be maintained at the same DC voltage. Alternatively, or additionally, at least y % of the axial segments of at least one rod of the rod set may be maintained at the same DC voltage, wherein y is selected from: ≥5; ≥10; ≥15; ≥20; ≥25; ≥30; ≥35; ≥40; ≥45; ≥50; ≥55; ≥60; ≥65; ≥70; ≥75; ≥80; ≥85; ≥90; or ≥95. Alternatively, or additionally, a DC voltage gradient may not be maintained along the mass filter At least some of the axial segments may have a thickness along the longitudinal axis of the mass filter selected from: ≤5 mm; ≤4 mm; ≤3 mm; ≤2 mm; ≤1 mm; ≤0.8 mm; ≤0.6 mm; ≤0.4 mm; ≤0.2 mm; or ≤0.1 mm. Relatively thin electrodes may be used so as to enable radially unstable ions that are not desired to be transmitted by the mass filter to pass through the gaps between the segments, rather than strike the electrodes.

At least some of the gaps each may have a length along the longitudinal axis of the mass filter of: ≥0.5 mm; ≥1 mm; ≥1.5 mm; ≥2 mm; ≥2.5 mm; ≥3 mm; ≥3.5 mm; ≥4 mm; ≥4.5 mm; ≥5 mm; ≥6 mm; ≥7 mm; ≥8 mm; ≥9 mm; or ≥10 mm. Relatively large gaps may be used so as to enable radially unstable ions that are not desired to be transmitted by the mass filter to pass through the gaps between the segments, rather than strike the electrodes.

The present invention also provides a method of mass spectrometry and/or ion mobility spectrometry comprising a method as described herein. The method may further comprise detecting ions transmitted by the mass filter(s), and/or or mass analysing ions transmitted by mass filter(s), and/or ion mobility analysing ions transmitted by the mass filter(s).

The first aspect of the present invention also provides a mass spectrometer or ion mobility spectrometer comprising:

a first mass filter comprising a plurality of electrodes;

a second mass filter comprising a plurality of electrodes arranged downstream of the first mass filter so as to receive ions transmitted by the first mass filter;

one or more voltage supplies; and a controller set up and configured to:

control said one or more voltage supplies so as to apply voltages to the first mass filter so that it mass selectively transmits only ions having a first range of mass to charge ratios, wherein at least one of the electrodes of the first mass filter comprises an aperture extending entirely through the electrode and/or comprises a recess extending only partially through the electrode, wherein the aperture and/or recess is arranged and configured such that when said voltages are applied to the first mass filter ions become unstable in the first mass filter and pass into or through the aperture and/or into the recess such that they are not transmitted by the first mass filter to the second mass filter; and control said one or more voltage supplies so as to apply voltages to the second mass filter so that it mass filters the ions transmitted by the first mass filter, and such that the second mass filter only transmits ions having a second range of mass to charge ratios that is a sub-set of the first range of mass to charge ratios.

The spectrometer may be arranged and configured such that it may perform any of the methods described herein. In particular, the controller may be set up and configured to perform the methods described herein.

The second aspect of the present invention also provides a mass filter comprising;

a plurality of electrodes, wherein at least one of the electrodes comprises an aperture extending entirely through the electrode and/or comprises a recess extending only partially through the electrode; and one or more voltage supplies arranged and configured to apply voltages to the electrodes such that ions having mass to charge ratios in a desired range are confined by the electrodes and are transmitted along and through the mass filter, whereas ions having mass to charge ratios outside of said desired range are unstable and pass into or through the aperture and/or into the recess such that they are filtered out by the mass filter;

wherein the mass filter is arranged and configured such that ions that pass into or through the aperture and/or into the recess impact on a surface such that they are not detected and are neutralised or discarded.

The mass filter may be arranged and configured to perform any of the methods described herein in relation to the second aspect of the present invention. In particular, the mass filter may have a controller set up and configured to perform the methods described herein.

The third aspect of the present invention also provides a mass filter comprising;

an axially segmented multipole rod set of electrodes having axial segments that are separated by gaps; and one or more voltage supplies arranged and configured to apply voltages to the electrodes such that ions having mass to charge ratios in a desired range are confined by the electrodes and are transmitted along and through the mass filter, whereas ions having mass to charge ratios outside of said desired range are unstable and pass into or through the gaps such that they are filtered out by the mass filter.

The mass filter may be arranged and configured to perform any of the methods described herein in relation to the third aspect of the present invention. In particular, the mass filter may have a controller set up and configured to perform the methods described herein.

For example, the mass filter may be set up and configured to apply an AC or RF voltage to the electrodes of the mass filter, wherein the frequency of the AC or RF voltage is <1 MHz or >1 MHz.

The mass filter may be set up and configured to maintain at least some of the axial segments of at least one rod of the rod set at the same DC voltage. Alternatively, or additionally, the mass filter may be set up and configured to maintain at least y % of the axial segments of at least one rod of the rod set at the same DC voltage, wherein y is selected from: ≥5; ≥10; ≥15; ≥20; ≥25; ≥30; ≥35; ≥40; ≥45; ≥50; ≥55; ≥60; ≥65; 70; ≥75; ≥80; ≥85; ≥90; or ≥95. Alternatively, or additionally, the mass filter may be set up and configured such that a DC voltage gradient is not maintained along the mass filter.

At least some of the axial segments may have a thickness along the longitudinal axis of the mass filter selected from: ≤5 mm; ≤4 mm; ≤3 mm; ≤2 mm; ≤1 mm; ≤0.8 mm; ≤0.6 mm; ≤0.4 mm; ≤0.2 mm; or ≤0.1 mm. Relatively thin electrodes may be used so as to enable radially unstable ions that are not desired to be transmitted by the mass filter to pass through the gaps between the segments, rather than strike the electrodes.

At least some of the gaps may each have a length along the longitudinal axis of the mass filter of: ≥0.5 mm; ≥1 mm; ≥1.5 mm; ≥2 mm; ≥2.5 mm; ≥3 mm; ≥3.5 mm; ≥4 mm; ≥4.5 mm; ≥5 mm; ≥6 mm; ≥7 mm; ≥8 mm; ≥9 mm; or ≥10 mm. Relatively large gaps may be used so as to enable radially unstable ions that are not desired to be transmitted by the mass filter to pass through the gaps between the segments, rather than strike the electrodes.

The mass filter may be arranged and configured such that ions that pass into or through the gaps impact on a surface such that they are not detected and are neutralised or discarded.

The present invention also provides a mass and/or ion mobility spectrometer comprising a mass filter as described herein, and further comprising a detector or analyser for detecting or analysing ions transmitted by the mass filter.

It is contemplated that in the method described in relation to the first aspect of the present invention, the first mass filter need not necessarily comprise an aperture extending entirely through the electrode and/or a recess extending only partially through the electrode.

Accordingly, from a fourth aspect the present invention provides a method of mass filtering ions comprising:

mass filtering ions using a first mass filter so as to mass selectively transmit only ions having a first range of mass to charge ratios; and mass filtering the ions transmitted by the first mass filter using a second mass filter, wherein the second mass filter only transmits ions having a second range of mass to charge ratios that is a sub-set of the first range of mass to charge ratios.

The method of the fourth aspect may comprise any of the features described in relation to the first aspect of the invention, except that the first mass filter need not necessarily comprise an aperture extending entirely through the electrode and/or a recess extending only partially through the electrode.

The fourth aspect of the present invention also provides a mass spectrometer or ion mobility spectrometer comprising:

a first mass filter;

a second mass filter arranged downstream of the first mass filter so as to receive ions transmitted by the first mass filter;

one or more voltage supplies; and a controller configured to:

control said one or more voltage supplies so as to apply voltages to the first mass filter so that it mass selectively transmits only ions having a first range of mass to charge ratios; and control said one or more voltage supplies so as to apply voltages to the second mass filter so that it mass filters the ions transmitted by the first mass filter, and such that the second mass filter only transmits ions having a second range of mass to charge ratios that is a sub-set of the first range of mass to charge ratios.

The spectrometer of the fourth aspect may comprise any of the features described in relation to the first aspect of the invention, except that the first mass filter need not necessarily comprise an aperture extending entirely through the electrode and/or a recess extending only partially through the electrode.

The spectrometer described herein may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The spectrometer may comprise an electrostatic ion trap or mass analyser that employs inductive detection and time domain signal processing that converts time domain signals to mass to charge ratio domain signals or spectra. Said signal processing may include, but is not limited to, Fourier Transform, probabilistic analysis, filter diagonalisation, forward fitting or least squares fitting.

The spectrometer may comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; ON 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The spectrometer may comprise a chromatography or other separation device upstream of an ion source. The chromatography separation device may comprise a liquid chromatography or gas chromatography device. The separation device may comprise: (i) a Capillary Electrophoresis ("CE") separation device; (ii) a Capillary Electrochromatography ("CEO") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene reagent ions.

According to embodiments of the present invention, a low performance resolving quadrupole is placed prior to a main analytical quadrupole. The main analytical quadrupole is set to transmit a sub-set of those mass to charge ratio values transmitted by the low performance quadrupole. Both quadrupoles are set with transmission windows substantially centred on the mass to charge ratio of interest. The range of mass to charge ratio values transmitted by the main analytical quadrupole is significantly less than that transmitted by the low performance quadrupole. Ions with unstable trajectories in the first, low performance quadrupole will be lost to the rods of the low performance quadrupole. This prevents the majority of unwanted background ions from contaminating the rods of the main analytical quadrupole and hence the performance of the analytical quadrupole is maintained over an extended period of time.

The main effect of local charging of the quadrupole rod electrodes is that the transmission at higher resolving powers is affected. For example, an analytical quadrupole may be operated with a mass to charge ratio transmission range of 0.2 to 2 amu, centred on an ion of interest. However, if the analytical quadrupole is operated at a significantly lower resolution, for example a mass to charge ratio transmission range of 10 to 50 amu centred on the mass to charge ratio of interest, then the effect of surface charging on the transmission of the mass to charge ratio of interest is far less severe.

BRIEF DESCRIPTION OF THE DRAWINGS

Various embodiments of the present invention will now be described, by way of example only, and with reference to the accompanying drawings in which.

DETAILED DESCRIPTION

Figure 1:
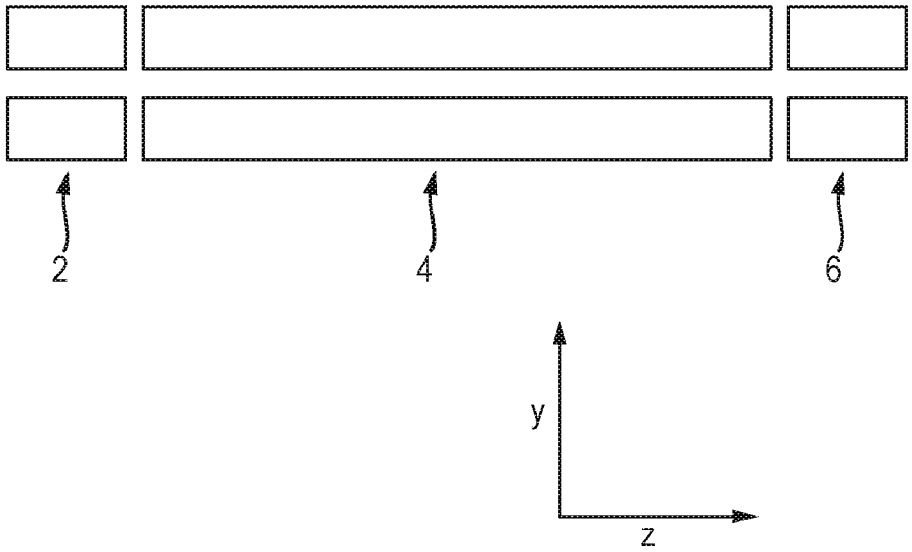
FIG. 1 shows a schematic of a prior art instrument comprising a pre-filter positioned upstream of a main analytical quadrupole.

FIG. 1 shows a cross-sectional view (in the y-z plane) of a schematic of a prior art instrument comprising a short RF-only pre-filter or Brubaker lens 2 positioned directly upstream of a main analytical quadrupole 4. This RF-only pre-filter 2 is supplied with an RF voltage having approximately 50-90% of the amplitude of the RF voltage that is applied to the main analytical quadrupole mass filter 4. The purpose of the pre-filter is to control fringing fields at the entrance to the main resolving quadrupole so as to allow ions to enter the RF-confined environment without becoming unstable and without initially experiencing the effects of the resolving DC applied to the main analytical quadrupole mass filter 4. An RF voltage and a DC resolving voltage is applied to the main analytical quadrupole mass filter 4 in order to mass filter the ions. An RF-only post-filter 6 is also provided at the exit of the analytical quadrupole mass filter 4 for conditioning ions for acceptance into a downstream device (not shown).

Figure 2:
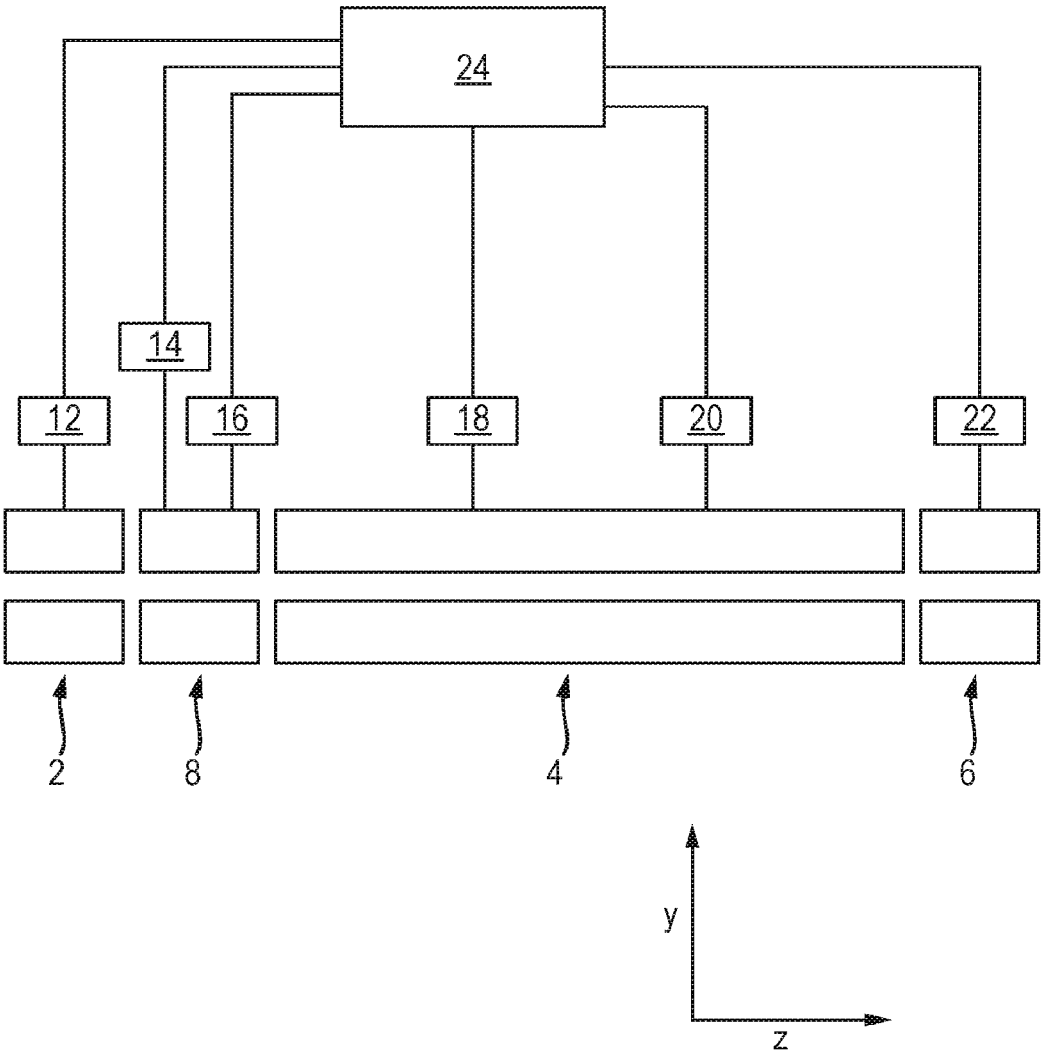
FIG. 2 shows a schematic of an instrument according to a first embodiment the present invention, which corresponds to the arrangement shown in FIG. 1 except that it comprises a low resolution analytical quadrupole between the pre-filter and the main analytical quadrupole.

FIG. 2 shows a cross-sectional view (in the y-z plane) of a schematic of an instrument according to an embodiment the present invention. The instrument is similar to that shown in FIG. 1, except that it further comprises a relatively short, low performance analytical quadrupole mass filter 8 positioned directly upstream the main analytical quadrupole mass filter 4. A short RF-only pre-filter or Brubaker lens 2 may be positioned directly upstream of the short analytical quadrupole mass filter 8. One or more RF-only post filter 6 may be positioned downstream of the main analytical quadrupole mass filter 4.

In operation, an RF voltage supply 12 applies an RF voltage to the electrodes of the pre-filter or Brubaker lens 2. The pre-filter or Brubaker lens 2 may comprise a quadrupole rod set. A DC voltage may not be applied to the pre-filter or lens 2. An RF voltage supply 14 and a DC voltage supply 16 apply RF and DC voltages, respectively, to the electrodes of the low performance analytical quadrupole mass filter 8 such that the low performance analytical quadrupole mass filter 8 is only capable of transmitting ions having a first range of mass to charge ratios. An RF voltage supply 18 and a DC voltage supply 20 apply RF and DC voltages, respectively, to the electrodes of the main analytical quadrupole mass filter 4 such that the main analytical quadrupole mass filter 4 is only capable of transmitting ions having a second range of mass to charge ratios, which is narrower than the first range of mass to charge ratios transmitted by the low performance analytical quadrupole mass filter 8. An RF voltage supply 22 applies an RF voltage to the electrodes of the post-filter 6, which may comprise a quadrupole rod set. A DC voltage may not be applied to the post-filter 6. A controller 24 is provided so as to control the above described voltage supplies.

In use, ions are transmitted into the pre-filter or lens 2 and guided through the pre-filter or lens 2 and into the low performance analytical quadrupole mass filter 8. The RF voltage applied to the pre-filter or lens 2 may be of lower amplitude than the RF voltage applied to the low performance analytical quadrupole mass filter 8 and/or to the main analytical quadrupole mass filter 4 so as to reduce transmission losses on entry to the low performance analytical quadrupole mass filter 8 due to fringe fields. The RF-only pre-filter or lens 2 may also act as a low mass cut-off filter since the RF voltage supply 13 may be controlled so as to apply RF voltages that radially confine only ions above a particular cut-off mass to charge ratio.

The ions are then transmitted into the low performance analytical quadrupole mass filter 8. The RF and DC voltages applied to mass filter 8 cause only ions in the first range of mass to charge ratios to be radially confined and hence transmitted to the exit of the mass filter 8. Ions having mass to charge ratios outside of this range are filtered out by the mass filter 8, e.g. by being radially excited into the electrodes of the mass filter 8. These ions are not transmitted to the exit of the mass filter 8.

Ions in the first range of mass to charge ratios are then transmitted into the main analytical mass filter 4. The RF and DC voltages applied to main analytical mass filter 4 cause only ions in the second, narrower range of mass to charge ratios to be radially confined and hence transmitted to the exit of the main analytical mass filter 4. Ions having mass to charge ratios outside of this second range are filtered out by the main analytical mass filter 4, e.g. by being radially excited into the electrodes of the mass filter 4. These ions are not transmitted to the exit of the main analytical mass filter 4. The provision of the low performance analytical quadrupole mass filter 8 enables many ions outside of the second range of mass to charge ratios to be filtered out upstream of the main analytical filter 4. As such, these ions are not required to be filtered out by the main analytical filter 4 and hence do not impact on the electrodes of the main analytical filter 4. This helps avoid contamination of the main analytical filter 4 and reduces surface charging of the main analytical filter 4, which would degrade its ion transmission properties.

The low performance analytical quadrupole mass filter 8 may be provided with the same amplitude and frequency RF voltage as the main analytical filter 4. It will therefore be appreciated that they may have the same RF voltage supply. However, the low performance analytical quadrupole mass filter 8 may be provided with the a lower amplitude DC voltage than the main analytical filter 4 such that the resolution for the low performance analytical quadrupole mass filter 8 is lower than that of the main analytical mass filter 4, but the set mass transmission window of both mass filters 8,4 may be centered on substantially the same mass to charge ratio value.

Ions in the second range of mass to charge ratios that are transmitted by the main mass filter 4 are transmitted downstream, e.g. into the post-filter 6. The RF voltage applied to the post-filter radially confines these ions so that they are guided downstream.

Figure 3:
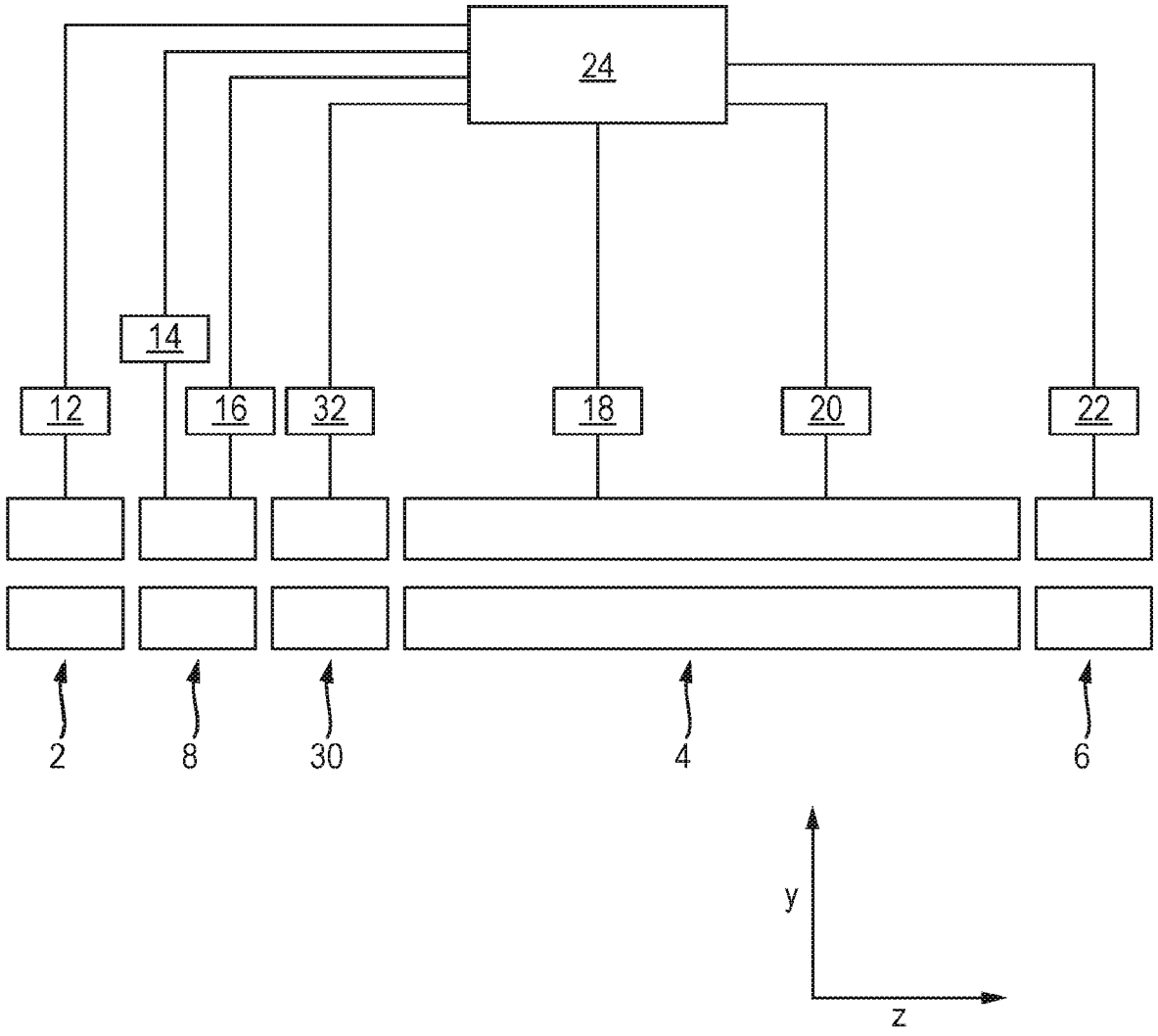
FIG. 3 shows a schematic of an instrument according to another embodiment the present invention, which corresponds to the embodiment shown in FIG. 2 except that it comprises a pre-filter between the low resolution analytical quadrupole and the main analytical quadrupole.

It has been recognised that fringing fields between the low resolution mass filter 8 and the main analytical mass filter 4 may cause a reduction in the performance of the main analytical mass filter 4. More specifically, the transmission of the main analytical mass filter at operational mass resolution may be reduced by these fringing field. FIG. 3 shows a schematic of an embodiment for overcoming this.

FIG. 3 shows a schematic of an instrument according to another embodiment of the present invention. This instrument corresponds to that shown in FIG. 2, except that a further RF-only pre-filter 30 is positioned directly between the low performance quadrupole mass filter 8 and the main analytical mass filter 4. The pre-filter 30 may comprise a quadrupole rod set. An RF voltage supply 32 is controlled by the controller 24 so as to apply an RF voltage to the electrodes of the pre-filter 30 for radially confining ions within the pre-filter 30 and guiding them between the low resolution mass filter 8 and main analytical mass filter 4. The RF-only pre-filter 30 effectively shields the main analytical mass filter 4 from the low resolution mass filter 8. In this instrument the performance of the main analytical mass filter 8 is therefore not compromised.

In operation the amplitude of the RF voltage applied to pre-filters 2 and 30 may be the same. As such voltage supplies 12 and 32 may be the same supply. The RF voltage applied to pre-filters 2 and 30 may be, for example, approximately 67% of the amplitude of the RF voltage that is applied to the low performance mass filter 8 and/or main analytical quadrupole 4.

An example of operation using typical operating parameters will now be described. The amplitude of the RF voltage, V, applied to the electrodes of the main analytical mass filter 4, at a given frequency ω may be set such that ions of interest having a mass to charge ratio M have a value of q=0.706. This may be the point directly below the apex of the Mathieu stability diagram for the main analytical mass filter 4.

The RF only pre-filter 2 acts as a low-mass cut-off such that ions having mass to charge ratio values such that q>0.908 become unstable and will be lost to the electrodes of the pre-filter 2.

If the amplitude of the RF voltage applied to the pre-filters 2,30 is 67% of that applied to the electrode rods of the main analytical mass filter 4 then the low-mass cut-off value $M_L$ of the pre-filters 2,30 is given by:

$$M_L = \frac{M \times 0.706 \times 0.67}{0.908} = 0.52M \tag{3}$$

Therefore, all ions having a mass to charge ratio below $M_L$ will be lost to the electrodes of the pre-filter 2.

The low resolution mass filter 8 may typically be operated with a mass to charge ratio transmission window of 20 Da. Under these conditions only mass to charge ratio values of M+/−10 Da will be transmitted to the main analytical mass filter 4, assuming the mass transmission window is centered on the mass to charge ratio of interest M. The main analytical mass filter 4 is typically operated with a mass to charge ratio transmission window of 0.5 to 1 Da, which may also be centered on the mass to charge ratio of interest M.

As described previously, the presence of the low resolution mass filter 4 ensures that the majority of unwanted ions do not impact upon the electrodes of the main analytical mass filter 4, thus minimising contamination and subsequent charging of the electrodes of the main analytical mass filter 4.

Many unwanted ions will impinge on the surfaces of the electrodes of the pre-filter 2 and low resolution mass filter 8. Although the performance of both of these devices is more robust to surface contamination and charging (e.g. since they are operated at relatively low resolutions), these devices may eventually become sufficiently contaminated that ion transmission through them is affected. In order to reduce surface contamination of these components, elongated slotted apertures or grooved recesses may be provided in the rod electrodes such that all or some of the ions which have unstable trajectories within these devices either pass through the rod electrodes or impinge on surfaces which are remote from, or are shielded from, the surfaces closest to the central ion transmission axis.

Figure 4:
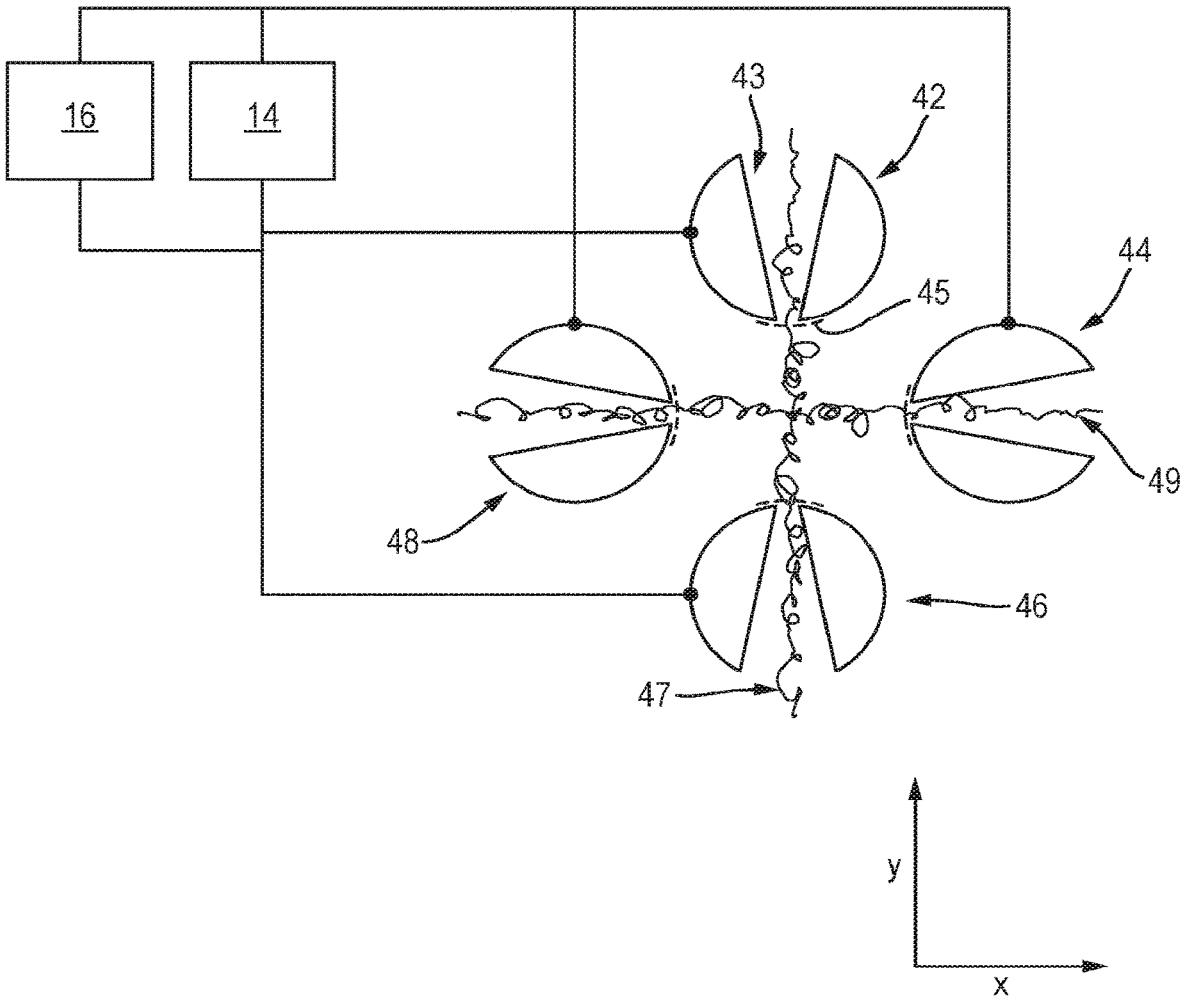
FIG. 4 shows a cross-sectional view of a quadrupole rod set having slotted apertured electrodes, according to an embodiment of the present invention.

FIG. 4 shows a cross-sectional view (in the x-y plane) of an embodiment of the low performance mass filter 8 described above. The mass filter 8 comprises four elongated rod electrodes 42-48 having longitudinal axes that extend in the z-direction. The RF voltage supply 14 is provided for delivering RF confinement voltages of opposite phases to different rod electrodes, as is known in the art. The DC power supply 16 is provided for delivering DC resolving voltages of opposite polarities to different rod electrodes, as is known in the art. Each of the rod electrodes 42-48 comprises a tapered slotted aperture 43 that extends all of the way through the electrode, from an ion entrance opening facing the ion optical axis through the mass filter to an ion exit opening facing radially outward from the mass filter. The slot 43 tapers outwardly in a direction from the ion entrance opening to the ion exit opening, i.e. the slot 43 has a cross sectional area in the x-z plane that increases in a direction from the ion entrance opening to the ion exit opening. A grid or mesh electrode 45 may be provided over the ion entrance opening of each slot 43 for substantially maintaining the electric field profile of a conventional quadrupole rod electrode, i.e. a rod electrode not having a slot 43.

FIG. 4 shows the trajectories 47 of positive ions that have mass to charge ratios that are higher than the mass to charge ratio which the mass filter 8 is set to transmit, i.e. for ions outside of the first range of mass to charge ratios. These ions exit the mass filter 8 in the y-direction through the slots 43. FIG. 4 also shows the trajectories 49 of negative ions that have mass to charge ratios that are lower than the mass to charge ratio which the mass filter 8 is set to transmit, i.e. for ions outside of the first range of mass to charge ratios. These ions exit the mass filter 8 in the x-direction through the slots 43. It will therefore be appreciated that the mass filter 8 is able to filter out ions without these filtered ions impacting on the electrodes 42-48 and hence without the filtered ions causing surface contamination and charging of the electrodes 42-48. Some of the filtered ions may impact on the electrodes 42-48, on the side walls of the slotted apertures 43 between the ion entrance openings and ion exit openings. However, even if this causes surface contamination and charging, this occurs away from the ion optical axis through the mass filter 8 and hence is less problematic.

Figure 5:
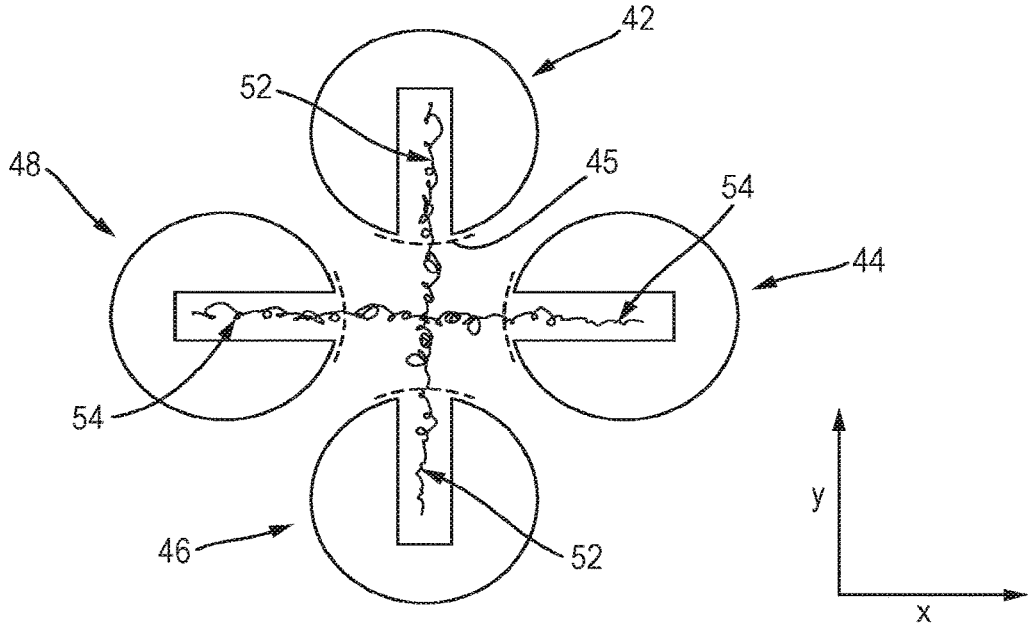
FIG. 5 shows a cross-sectional view of a quadrupole rod set having grooved recessed electrodes, according to an embodiment of the present invention.

FIG. 5 shows a cross-sectional view (in the x-y plane) of another embodiment of the low performance mass filter 8. This embodiment is the same as that shown and described in relation to FIG. 4, except that each of the rod electrodes 42-48 comprises a grooved recess 50 in the inner surface of the electrode, rather than an aperture 43 extending entirely through the electrode. Each recess 50 extends part way through its respective electrode 42-47, from an ion entrance opening facing the ion optical axis through the mass filter 8 to an ion exit opening facing radially outward from the mass filter 8. The recess 50 may taper outwardly in a direction from the ion entrance opening to the ion exit opening (not shown), i.e. the recess 50 may has a cross-sectional area in the x-z plane that increases in a direction from the ion entrance opening to the ion exit opening. A grid or mesh electrode 45 may be provided over the ion entrance opening of each recess 50 for substantially maintaining the electric field profile of a conventional quadrupole rod electrode, i.e. a rod electrode not having a recess 50.

FIG. 5 shows the trajectories 52 of positive ions that have mass to charge ratios that are higher than the mass to charge ratio which the mass filter 8 is set to transmit, i.e. for ions outside of the first range of mass to charge ratios. These ions travel in the y-direction and enter the recesses 50 in the electrodes 42,46 of the mass filter 8. FIG. 5 also shows the trajectories 54 of negative ions that have mass to charge ratios that are lower than the mass to charge ratio which the mass filter 8 is set to transmit, i.e. for ions outside of the first range of mass to charge ratios. These ions travel in the x-direction and enter the recesses 50 in the electrodes 44,48 of the mass filter 8. It will therefore be appreciated that the mass filter 8 is able to filter out ions without these filtered ions impacting on the inner surfaces of the electrodes 42-48 that face the ion transmission axis, and hence without the filtered ions causing surface contamination and charging of the electrodes 42-48 at these surfaces. As such, ions with stable trajectories through the mass filter 8 are shielded from surface charging on contaminated areas.

Figure 6:
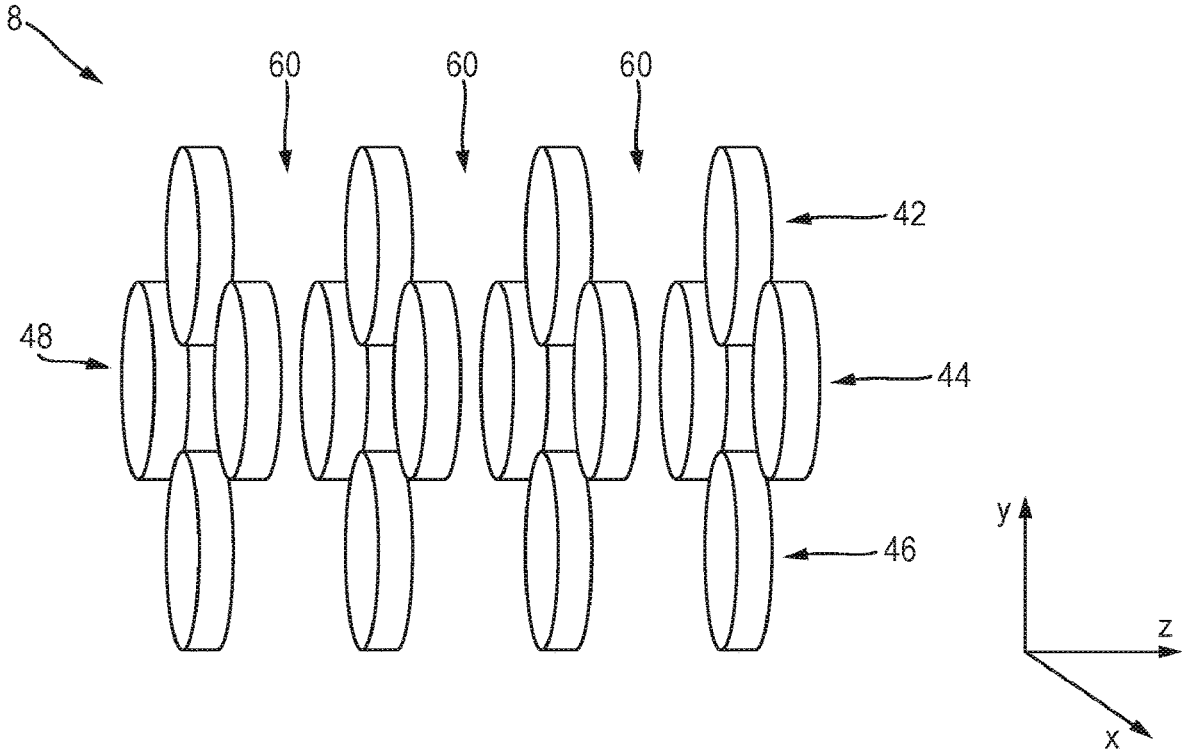
FIG. 6 shows a perspective view of a of a quadrupole rod set that is axially segmented, according to an embodiment of the present invention

FIG. 6 shows a perspective view of another embodiment of the low performance mass filter 8. The mass filter 8 is configured and operates in the same manner as the mass filters described above, except that the electrodes 42-48 of the mass filter 8 need not comprise apertures 43 or recesses 52. Each of the rod electrodes 42-48 of the mass filter 8 is segmented in the longitudinal direction (z-direction), with gaps 60 between the axial segments of the rod set. The mass filter 8 is operated in the same way as described above, such that ions having mass to charge ratios outside of the first range are not stably confined and are radially excited to the extent that they are not transmitted by the mass filter 8. The gaps 60 reduce the surface area of the electrodes 42-48 on which the unstable ions may impact, thus reducing surface charging and contamination of these electrodes 42-48. The axial spacing between the electrode segments in the longitudinal direction (z-direction) may be chosen to be as large as possible and/or the thickness of the electrode segments in the longitudinal direction (z-direction) may be chosen to be as small as possible, provided that the required resolution of the mass filter 8 is maintained in order to minimise the surface area that can be contaminated by filtered ions.

Although the electrodes 48-48 have circular cross-sections (in the x-y plane), other shapes may be used. For example, the electrodes may be substantially hyperbolic (in the x-y plane), or they may have a substantially circular inner bore (e.g. may be annular).

It is also contemplated that the configurations shown in FIGS. 4 and 5 may be axially segmented in the manner shown and described in relation to FIG. 6 in order to further reduce the contamination close to the ion optical axis of the mass filter 8.

The provision of slotted apertures and/or grooved recesses in the electrodes of the mass filter 8 may have an impact on the analytical performance of a quadrupole mass filter, as it may reduce the transmission of ions of interest as the mass resolution is increased. However, at lower resolutions the transmission of the quadrupole is not significantly affected and hence this arrangement is suitable at least for use as the low resolution band-pass mass to charge ratio filter 8 used to protect the higher resolution analytical quadrupole mass filter 4.

The instability of low mass to charge ratio ions within the RF-only pre-filter device 2 may not be as directional as in the case of a resolving quadrupole mass filter. However, slotted apertures and/or grooved recesses may be provided in such a pre-filter 2, or the pre-filter 2 may be segmented, so as to reduce the extent of surface contamination and decrease the effects of surface charging.

An ion optical model (SIMION 8) was constructed in order to demonstrate the principal of operation of the instrument shown in FIG. 3. The RF-only quadrupole filters 2 and 30, and the low resolution analytical quadrupole mass filter 8 were each 16 mm in length. The analytical quadrupole mass filter 4 was 130 mm in length. All of the rod electrodes had a radius of 6 mm and were arranged to form an inscribed circle of radius 5.33 mm. The frequency of the RF voltage applied to all of the rods was set to 1.185 MHz. The main analytical mass filter 4 was set to transmit a mass to charge ratio of 556. This corresponds to an RF amplitude of 1601.8 V (0-peak). The same amplitude of RF voltage was applied to the low resolution mass filter 8. The low resolution mass filter 8 was modeled non-tapered slotted apertures. Each of the slots either had a width in the x-direction or y-direction of 1 mm. The amplitude of the RF voltage applied to the RF-only filters 2 and 30 was set to 67% of the amplitude of the main analytical mass filter 4, i.e. 1073.2 V (0-pk). The kinetic energy of the ions entering the quadrupole assembly was modeled as 1 eV. A resolving DC voltage of 268.7 V was applied to the main analytical mass filter 4, resulting in a mass to charge ratio transmission window of approximately 0.5 Da. Different DC resolving voltages were modeled as being applied to the low resolution mass filter 8 corresponding to theoretical mass to charge ratio transmission windows of 60, 40, 20 and 10 Da, so as to examine the effect on the transmission of ions having a mass to charge ratio of 556 through the entire instrument.

Figure 7:
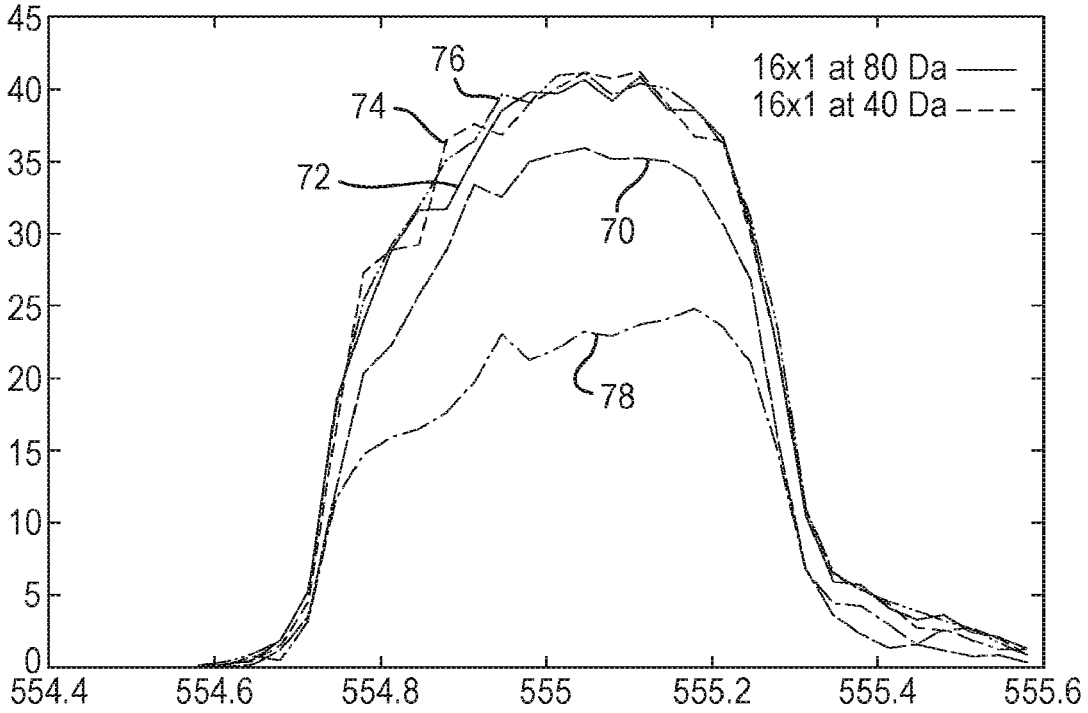
FIG. 7 shows the relative transmissions of ions through different instruments.

FIG. 7 shows the results of the model described above. It shows the relative transmission of an ensemble of ions having a mass to charge ratio of 556, for a narrow quadrupole scan from m/z=554.4 to m/z=555.6 under different conditions of the low resolution mass filter 8. Plot 70 shows the relative transmission of ions having a mass to charge ratio of 556 for the arrangement of the prior art instrument shown in FIG. 1. The three closely spaced plots 72,74,76 show the relative transmission for the embodiment of the invention shown in FIG. 3. These transmission plots 72,74,76 were generated with the DC resolving voltage set for the low resolution mass filter 8 such that the theoretical resolution of this device was 80 Da, 40 Da and 20 Da respectively. No overall drop in ion transmission was observed for these settings. However, plot 78 shows the results for a theoretical transmission window of 10 amu on low resolution mass filter 8 and results in a reduction of 40-50% in transmission.

Figure 8:
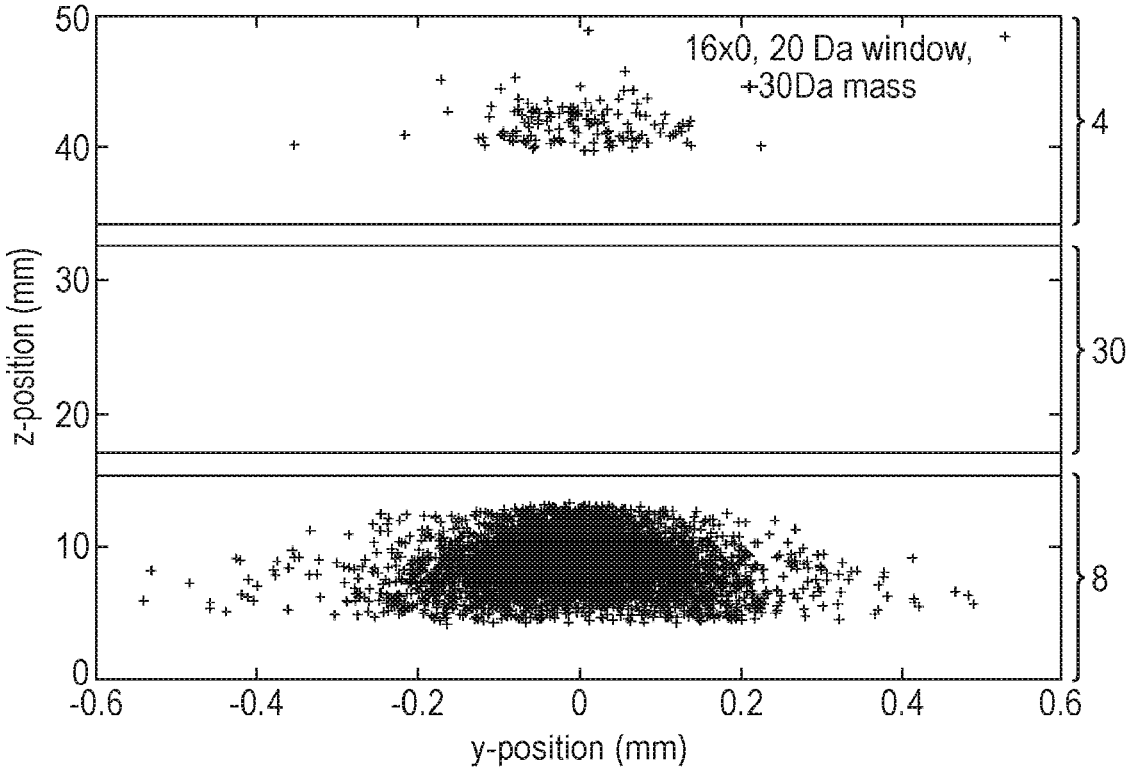
FIG. 8 shows the locations in an instrument at which the ions impact on the rod electrodes.

FIG. 8 shows the position in z- and y-directions at which ions having a mass to charge ratio of 586 exit the radius of the inscribed circle bounded by quadrupoles 4,8 and 30 in FIG. 3. The slotted, low-resolution mass filter 8 was set to transmit a mass to charge ratio range of 20 Da, centered at a mass to charge ratio of 556. It can be seen from FIG. 8 that 97% of all ions having a mass to charge ratio of 586 (30 amu higher than the central mass to charge ratio set to be transmitted) reach the inner surfaces of the rods within a radial region of +/−0.5 mm in the y-direction, corresponding to the position of the 1 mm slots in the rods, and within 16 mm in the z-direction, corresponding to the length of the low resolution mass filter 8. It can be seen that ions having a mass to charge ratio of 586 are not incident on the RF-only pre-filter 30. Only 3% of the ions having a mass to charge ratio of 586 are incident on the electrodes of the main analytical mass filter 4 within the first 16 mm of its length. It is therefore evident that the low resolution mass filter 8 protects the main analytical mass filter 4 from being contaminated by undesired ions having a mass to charge ratio of 586.

Figure 9:
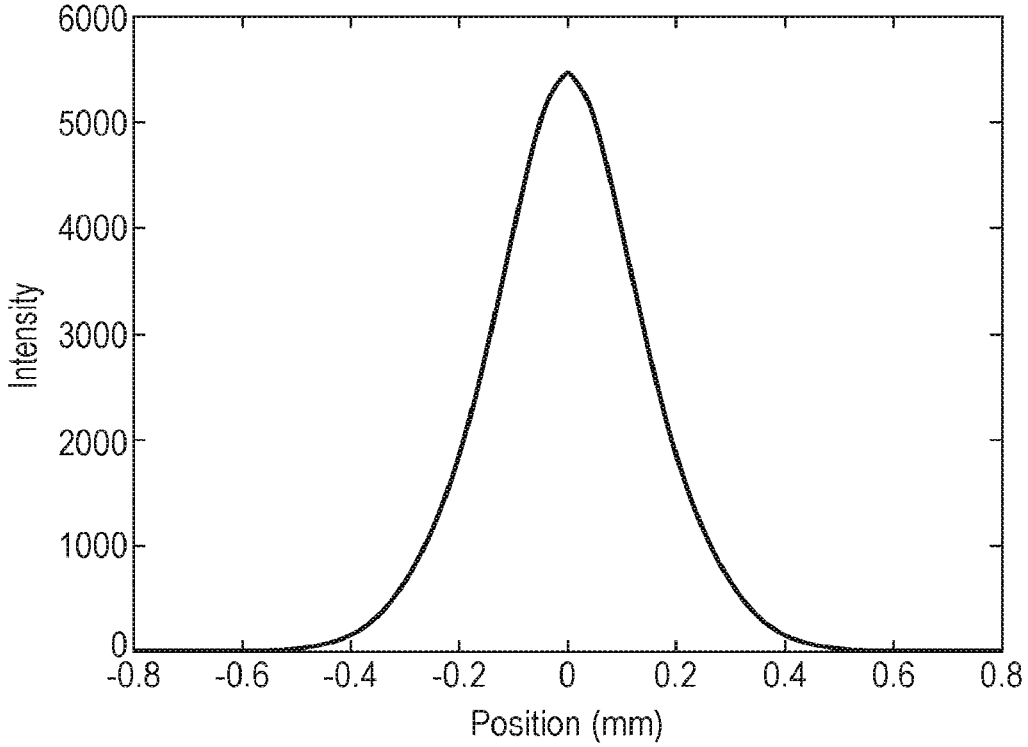
FIG. 9 shows the positions at which ions impact on the rod electrodes in an analytical quadrupole.

FIG. 9 shows a histogram of the number of ions that travel in the y-direction and reach the surfaces of the rods of the low resolution mass filter 8, verses their position in the x-direction relative to the centres of the slots 43 in the rods. The data was modeled for ions having a mass to charge ratio of 1080 and under the same conditions as described in relation to FIG. 8. It can be seen that the majority of the ions pass through the 1 mm wide slots in the rods and so will not contribute significantly to surface contamination on the rods. As described above in relation to equation 3, mass to charge ratios below 289 (=556×0.52) will become unstable in the RF-only pre-filter 2 and will be lost to the rod electrodes of the pre-filter 2.

Figure 10:
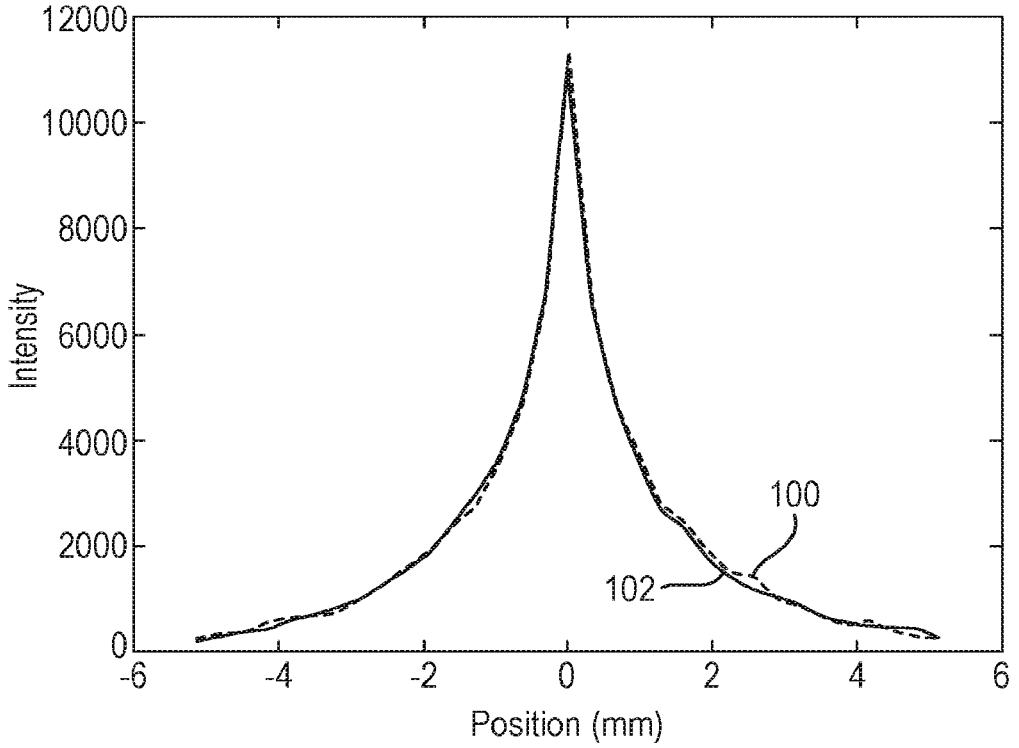
FIG. 10 shows the positions at which ions impact on the rod electrodes in a pre-filter quadrupole.

FIG. 10 shows a histogram 100 of the number of ions that travel in the y-direction and reach the surfaces of the rods of the pre-filter 2, verses their position in the x-direction relative to the centres of the rods; and shows a histogram of the number of ions 102 that travel in the x-direction and reach the surfaces of the rods of the pre-filter 2, verses their position in the y-direction relative to the centres of the rods. The data was modeled for ions having a mass to charge ratio of 184 and under the same conditions as described in relation to FIG. 8. It can be seen from FIG. 10 that, although ejection is less directional than that for the resolving quadrupole shown in FIG. 9, ions of this mass to charge ratio are ejected towards the rods in both the x- and y-dimensions. It can be seen that in this case a 2 mm wide slot in each of the pre-filter rods 2 would result in approximately 50% of the low mass ions passing through the slots, and hence not significantly contributing to surface contamination in the pre-filter 2. Even larger slots may be provided in this RF pre-filter 2 without significantly affecting the performance of the device, resulting in a further reduction in surface contamination.

The RF-only pre-filter 30 may not have slotted apertures or grooved recesses in order that the entrance conditions to the main analytical mass filter 4 are maintained at ideal conditions for transmission and resolution of the main analytical mass filter 4. This pre-filter 30 may be maintained at the same RF amplitude as pre-filter 2. As such, there will be substantially no ions incident on the surfaces of the rod electrodes in pre-filter 30.

It will be appreciated that under the conditions described it would be expected that a significant number of ions with mass to charge ratios greater than 586 Da and less than 526 will pass into or through the slots in the low resolution analytical mass filter 8 or in the pre-filter 2. Therefore, these ions would not contribute significantly to any performance losses due to contamination and surface charging.

Although the low performance mass filter 8 has been described as being used to protect and extend the operational lifetime of the higher performance analytical mass filter 4, the apparatus described may be used for many other applications where a low mass cut-off or mass to charge ratio band pass is required.

Figure 11:
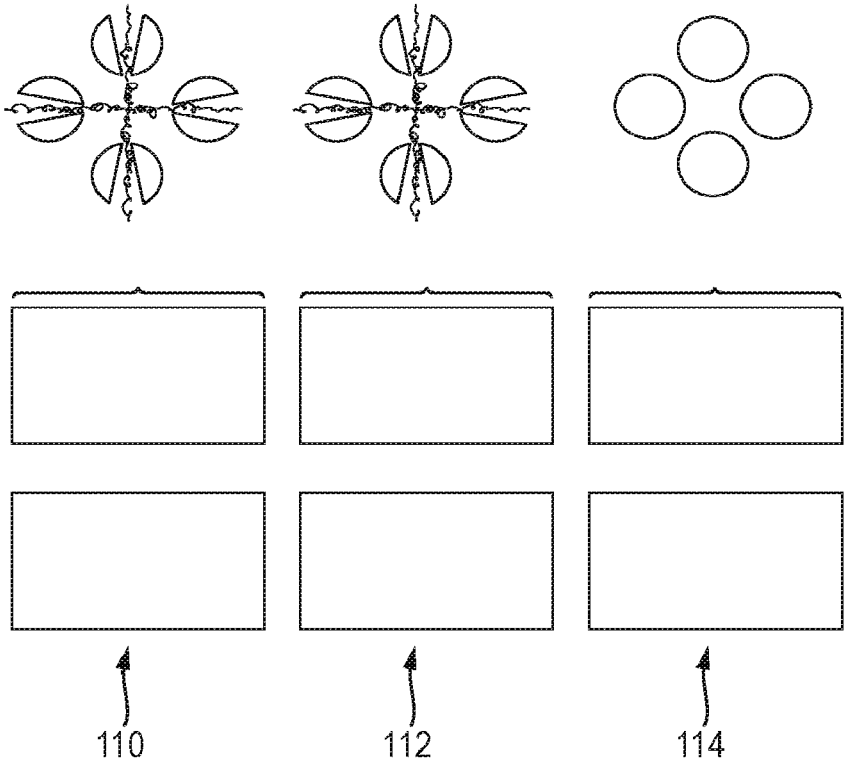
FIG. 11 shows an embodiment of a band pass filter.

For example, FIG. 11 illustrates a low resolution band pass mass filter having reduced surface contamination characteristics. The instrument comprises a first RF-only filter 110 having longitudinal slotted apertures or grooved recesses of the type described above, followed by a low performance analytical mass filter 112 having slotted apertures or grooved recesses of the type described above, followed by a second RF-only mass filter 114 of the type describe above but having no slotted apertures or grooved recesses. This instrument may be used as a robust band pass filter, e.g. prior to another downstream analytical device other than, or in addition to, the main analytical mass filter 4 as previously described. For example, the downstream analytical device may be an ion trap or time of flight mass analyser.

Alternatively, the instrument of FIG. 11 may be used as a low performance robust band pass filter arranged downstream of a separate analytical device. For example, the band pass filter may be arranged downstream of an ion mobility separator (IMS). The range of mass to charge ratios passed by the band pass filter may be fixed or may be scanned in synchronism with the delivery of ions from the upstream device. For example, the band pass filter may be used to select ions eluting from an upstream IMS device corresponding to particular charge states. This may be achieved because ions of a given charge state tend to follow a relationship between ion mobility and mass to charge ratio, and the IMS device and band pass filter may be used in combination so as to only transmit ions following such a relationship.

Figure 12:
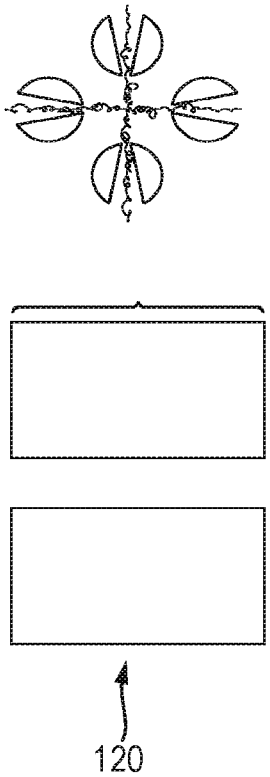
FIG. 12 shows an embodiment of low mass cut-off filter.

FIG. 12 shows a simple, robust low mass cut-off filter 120. The filter comprises a set of RF-only quadrupole rods having longitudinal slots or grooves of the type described above for minimising surface contamination. This device may be used downstream of an IMS device, e.g. to prevent ions with certain ion mobility drift times and (e.g. maximum) mass to charge ratio values reaching a downstream mass analyser. This may be used to discriminate against ions with different charge states, since ions having the same charge state but different mass to charge ratios may be received at the filter, but only ions of one of the mass to charge ratio values may be transmitted.

In all of the arrangements described the presence of slotted apertures or grooved recesses in the electrodes, or axially segmented electrodes, reduces surface contamination of the electrodes and hence extends the operational lifetime of the various mass filters and/or of a downstream mass or ion mobility analyser.

Although the present invention has been described with reference to preferred embodiments, it will be understood by those skilled in the art that various changes in form and detail may be made without departing from the scope of the invention as set forth in the accompanying claims.

For example, the slotted apertures and/or grooved recesses in the rods may be present over only part of the length of the rods, or may be present over the entire length of the rods.

The presence of an RF-only pre-filter 2 upstream of the low resolution mass filter 8 may not be required for operation. This is because the mass filter 8 is operated at relatively low resolution and therefore the entrance conditions may not have a significant effect on transmission for ions at the centre of the mass to charge ratio transmission window. In this case, low mass to charge ratios may be ejected through one set of slotted apertures and high mass to charge ratios may be ejected through the other set of slotted apertures in the mass filter 8.

It is contemplated that the inscribed radii of the different rod sets may be different.

Different DC voltages may be applied to the different rod sets so as to control the energy of the ions through each rod set.

A dipole excitation voltage may be applied to the low resolution mass filter 8 and/or the RF-only filter 2 in order to help move ions in a direction towards the slotted apertures or recesses as the ions become unstable.

It is also contemplated that the main analytical mass filter 4 may comprise apertures or recesses, or be axially segmented, as described in relation to the low resolution mass filter 8 in order to reduce surface contamination.

The invention claimed is:

1. A method of mass filtering ions comprising:

mass filtering ions using a first mass filter so as to mass selectively transmit only ions having a first range of mass to charge ratios; and mass filtering the ions transmitted by the first mass filter using a second mass filter, wherein the second mass filter only transmits ions having a second range of mass to charge ratios that is a sub-set of the first range of mass to charge ratios;

wherein at least one electrode of the first mass filter comprises an aperture extending entirely through the electrode and/or comprises a recess extending only partially through the electrode, wherein the aperture and/or recess is arranged and configured such that ions that are unstable in the first mass filter pass into or through the aperture and/or into the recess such that they are not transmitted by the first mass filter;

wherein the ions transmitted by the first mass filter are guided into the second mass filter using a RF-only ion guide arranged between the first mass filter and the second mass filter; and wherein the first mass filter, the second mass filter and the RF-only ion guide are located in a single vacuum chamber.

2. The method of claim 1, wherein the first mass filter and/or second mass filter is a multipole mass filter, such as a quadrupole mass filter.

3. The method of claim 1, comprising applying RF and DC voltages to electrodes of the first mass filter and/or to electrodes of the second mass filter so as to confine ions desired to be transmitted between the electrodes and to cause ions that are not desired to be transmitted to be unstable and not confined between the electrodes.

4. The method of claim 1, comprising:

guiding the ions into the first mass filter using a second RF-only ion guide arranged directly upstream of the first mass filter.

5. The method of claim 1, wherein at least one of the electrodes of the second mass filter comprises an aperture extending entirely through the electrode and/or comprises a recess extending only partially through the electrode, wherein the aperture and/or recess is arranged and configured such that ions that are unstable in the second mass filter pass into or through the aperture and/or into the recess such that they are not transmitted by the second mass filter.

6. The method of claim 1, wherein the electrode having the aperture or recess is elongated in a direction along the length of the first mass filter, and wherein the aperture is a slotted aperture or the recess is a slotted recess.

7. The method of claim 1, comprising arranging a conductive grid or mesh over, or in, the aperture or recess so as to support an electric field generated by the electrode.

8. The method of claim 1, wherein ions that pass into or through the aperture or recess are not detected and are neutralised or discarded.

9. The method of claim 1, wherein at least some of the electrodes of the first mass filter are heated.

10. The method of claim 1, further comprising detecting ions transmitted by the mass filter and/or mass analysing ions transmitted by the filter.

11. The method of claim 1, wherein the first mass filter, the second mass filter and the RF-only ion guide are maintained at the same pressure.

12. The method of claim 1, wherein at least one of the electrodes of the first mass filter and/or at least one of the electrodes of the second mass filter is axially segmented so as to comprise separate individual segments that are spaced a distance apart along the longitudinal axis by one or more gaps so as to not be connected such that ions that are unstable in the first mass filter pass into or through the gaps such that they are not transmitted by the first mass filter.

13. The method of claim 1, wherein at least one electrode of the first mass filter comprises a longitudinal recess extending only partially through the thickness of the electrode so as to not form an aperture through the electrode; and wherein the recess is arranged and configured such that ions that are unstable in the first mass filter pass into the recess such that they are not transmitted by the first mass filter.

14. The method of claim 1, wherein the aperture and/or recess extend a full length of said at least one electrode.

15. The method of claim 1, wherein pressure in the vacuum chamber is ≥0.1 mbar.

16. A mass and/or ion mobility spectrometer comprising:

a first mass filter comprising a plurality of electrodes;

a second mass filter comprising a plurality of electrodes arranged downstream of the first mass filter so as to receive ions transmitted by the first mass filter;

a RF-only ion guide arranged between the first mass filter and the second mass filter so as to guide the ions transmitted by the first mass filter into the second mass filter, wherein the first mass filter, the second mass filter and the RF-only ion guide are located in a single vacuum chamber of the spectrometer;

one or more voltage supplies; and a controller set up and configured to:

control said one or more voltage supplies so as to apply voltages to the first mass filter so that it mass selectively transmits only ions having a first range of mass to charge ratios, wherein at least one of the electrodes of the first mass filter comprises an aperture extending entirely through the electrode and/or comprises a recess extending only partially through the electrode, wherein the aperture and/or recess is arranged and configured such that when said voltages are applied to the first mass filter ions become unstable in the first mass filter and pass into or through the aperture and/or into the recess such that they are not transmitted by the first mass filter to the second mass filter; and control said one or more voltage supplies so as to apply voltages to the second mass filter so that it mass filters the ions transmitted by the first mass filter, and such that the second mass filter only transmits ions having a second range of mass to charge ratios that is a sub-set of the first range of mass to charge ratios.

17. A mass and/or ion mobility spectrometer comprising:

a first mass filter comprising a plurality of electrodes;

a second mass filter comprising a plurality of electrodes arranged downstream of the first mass filter so as to receive ions transmitted by the first mass filter;

a RF-only ion guide arranged between the first mass filter and the second mass filter so as to guide the ions transmitted by the first mass filter into the second mass filter, wherein the spectrometer is configured to maintain the first mass filter, the second mass filter and the RF-only ion guide at the same pressure;

one or more voltage supplies; and a controller set up and configured to:

control said one or more voltage supplies so as to apply voltages to the first mass filter so that it mass selectively transmits only ions having a first range of mass to charge ratios, wherein at least one of the electrodes of the first mass filter comprises an aperture extending entirely through the electrode and/or comprises a recess extending only partially through the electrode, wherein the aperture and/or recess is arranged and configured such that when said voltages are applied to the first mass filter ions become unstable in the first mass filter and pass into or through the aperture and/or into the recess such that they are not transmitted by the first mass filter to the second mass filter, and control said one or more voltage supplies so as to apply voltages to the second mass filter so that it mass filters the ions transmitted by the first mass filter, and such that the second mass filter only transmits ions having a second range of mass to charge ratios that is a sub-set of the first range of mass to charge ratios.

* * * * *